US005353891A

United States Patent [19]

Griek et al.

[11] Patent Number: 5,353,891

[45] Date of Patent: Oct. 11, 1994

[54] STANCHION ASSEMBLY

[75] Inventors: Cornelis J. Griek, Belgrave South; Anthony K. Mitchinson, Mooroolbark, both of Australia

[73] Assignee: DGS Property Pty. Ltd., Australia

[21] Appl. No.: 646,776

[22] PCT Filed: Jul. 10, 1989

[86] PCT No.: PCT/AU89/00291

§ 371 Date: Mar. 1, 1991

§ 102(e) Date: Mar. 1, 1991

[87] PCT Pub. No.: WO90/00657

PCT Pub. Date: Jan. 25, 1990

[30] Foreign Application Priority Data

| | | | |
|---|---|---|---|
| Jul. 11, 1988 | [AU] | Australia | PI9230/88 |
| Dec. 2, 1988 | [AU] | Australia | PJ1756/88 |
| May 10, 1989 | [AU] | Australia | PJ4105/89 |

[51] Int. Cl.[5] ..... B21F 27/00; E04H 17/14

[52] U.S. Cl. ..... 182/45; 182/113; 248/228; 248/231.4; 256/59

[58] Field of Search ..... 182/45, 113; 248/228, 248/231.4; 256/DIG. 6, 60, 59, 68

[56] References Cited

U.S. PATENT DOCUMENTS

| | | | |
|---|---|---|---|
| 462,319 | 11/1891 | Loehner et al. | 248/231.4 |
| 1,836,197 | 12/1931 | Soule | 248/228 X |
| 3,077,613 | 2/1963 | Mayer | 248/231.7 X |
| 3,358,957 | 12/1967 | Lindenmuth | 248/231.4 X |
| 3,480,242 | 11/1969 | Cleveland . | |
| 3,480,257 | 11/1969 | Bourn et al. . | |
| 3,863,900 | 2/1975 | Dagiel et al. . | |
| 3,880,405 | 4/1975 | Brueske . | |
| 3,920,221 | 11/1975 | Berry et al. . | |
| 3,995,833 | 12/1976 | McLaughlin et al. | 256/59 |
| 4,037,824 | 7/1977 | Whitmer | 182/113 X |
| 4,078,772 | 3/1978 | Carbone | 256/68 X |
| 4,171,032 | 10/1979 | Woolslayer et al. | 248/228 X |
| 4,666,131 | 5/1987 | Kettelkamp, Sr. et al. . | |

FOREIGN PATENT DOCUMENTS

| | | | |
|---|---|---|---|
| 0001342 | 4/1979 | European Pat. Off. . | |
| 864334 | 1/1953 | Fed. Rep. of Germany . | |
| 1684232 | 5/1971 | Fed. Rep. of Germany . | |
| 3624011 | 1/1988 | Fed. Rep. of Germany . | |
| 857321 | 9/1940 | France . | |
| 2408752 | 7/1979 | France | 248/228 |
| 2520417 | 7/1983 | France . | |
| 2589182 | 4/1987 | France . | |
| 183764 | 8/1922 | United Kingdom . | |

*Primary Examiner*—Alvin C. Chin-Shue
*Attorney, Agent, or Firm*—Lucas & Just

[57] ABSTRACT

The adjustable stanchion assembly (10) for a frame building includes a support post (12) which may carry one or more safety rails (48), safety netting and/or, for example, a display sign. The support post (12) is clamped to the building by a clamping mechanism including a connection rod (26) from which the support post (12) extends, to which are relatively adjustably connected two clamps (28). Each clamp (28) has jaws (62) which are shaped so that it can only be located on and removed from a frame member (14, 16) of the building having a correspondingly sized L-shaped section (24) by rotating the clamp (28) relative to the section (24). The clamp (28) may be locked onto the frame member (14, 16).

28 Claims, 5 Drawing Sheets

STANCHION ASSEMBLY

The present invention relates to frame buildings, especially steel framed buildings, and is particularly concerned with an adjustable stanchion assembly for a frame building and capable of carrying a structure on the building.

Structures which may be advantageously supported on a building, or a building construction, include especially a safety barrier, for example, to prevent or assist in preventing construction site workers accidentally falling from the construction, and display signs. A safety barrier may advantageously be able to have connected to it a fall arrest system whereby someone connected to the safety barrier may be protected from serious injury in an accidental fall. In order to provide adequate support, it is necessary that a stanchion assembly be securely connected to the building and readily appropriate for use in different situations including on different frame buildings. It is also advantageous if the stanchion assembly can be readily removed from the building, for example, in the case of a stanchion assembly associated with a safety barrier, when the building construction has been substantially completed.

U.S. Pat. No. 3,920,221 discloses one stanchion assembly which is suitable for use only on the upper flange of an I-beam. The major portion of the stanchion assembly is intended to be encased in concrete when concrete is poured onto the I-beam.

U.S. Pat. No. 4,666,131 proposes another stanchion assembly in which a clamp is provided to secure the stanchion to a roof beam from the underside so that the clamp may be removed from the beam when the roof has been completed. The clamp may be readily removed from the beam by simple unscrewing of a pair of clamping screws.

According to the present invention there is provided an adjustable stanchion assembly for a frame building, comprising a support post capable of receiving a structure to be carried by the assembly and secured to a clamping mechanism comprising an elongate connection member and at least two clamps which are selectively relatively adjustable along the elongate connection member and which comprise means for engaging the clamps with one or more of the frame members of the frame building, each said clamping means comprising jaws having a mouth of restricted maximum width and a throat portion behind the mouth having a dimension substantially parallel to the width of the mouth which is greater than said maximum width whereby an L-shaped section of the frame member having a distal leg of greater height than the maximum width of the mouth can only be received in and removed from the jaws by relative rotation of the clamp around said L-shaped section.

The stanchion assembly of the present invention is particularly adapted for use with, for example, C- or Z-shaped purlins or girts which have a lip at each end defining the distal leg of an L-shaped section of the purlin or girt. However, the stanchion assembly is also suitable for use with other shapes of frame member, including I-beams, provided they have a flange which can be received in at least the mouth of the clamps.

By the term "frame building" is meant a building or building construction having at least one frame member to which the adjustable stanchion assembly of the invention can be affixed. Thus, for example, only the roof or floor construction of the building may be frame-like or the whole building may comprise a frame construction.

The stanchion assembly may be connected to one or more frame members of a wall structure so that the elongate connection member extends upright or the elongate connection member may be clamped to one or more floor or roof frame members which extend horizontally or otherwise. Generally, the support post of the stanchion assembly will extend upwardly from the clamping mechanism, but in some circumstances it may be desirable to have it projecting downwardly or outwardly from the building.

The support post conveniently is adjustably secured to the clamping mechanism, Preferably at one end, for example by a sleeve construction and a locking device, and may be removable from the clamping mechanism for storage and transportation purposes. The adjustability of the securement of the support post to the clamping mechanism is particularly convenient where the portion of the elongate connection member to which the support post is secured projects outwardly from the building since it will permit variation of the distance between the support post and the building. Conveniently the support post is variable in length, and this may be by way of a telescopic construction. The support post may include means by which the structure to be carried by the stanchion assembly may be mounted thereon, for example wedging means to receive the generally horizontal rails of a safety barrier and/or hooks to engage netting extending between adjacent stanchion assemblies.

One of the at least two clamps of the clamping mechanism may be rigidly connected with the support post or with a bracket of or for the support post which engages the connection member, whether or not the support post is adjustably secured to the elongate connection member, but preferably the at least two clamps are selectively adjustable along the elongate connection member and relative to the support post.

Advantageously the clamping mechanism is such that the at least two clamps cannot be rotated relative to the elongate connection member and this may be by providing the connection member and the co-operating parts of the clamping mechanism with a suitable key and keyway arrangement. However, preferably the elongate connection member comprises a rod of non-circular cross-section, for example square, which may be received in a sleeve of corresponding cross-section in the or each clamp which is selectively adjustable along the elongate connection member. Releasable locking means may also be provided to selectively resist the adjustment along the connection member.

The provision of a clamping mechanism comprising the elongate connection member and at least two clamps permits the connection member to extend across two or more laterally extending frame members and one clamp to be secured to each. Where the frame members have the aforementioned L-shaped section, this arrangement prevents rotation of the clamping mechanism relative to the frame members so that the clamping mechanism cannot be disengaged from the-frame members unless it is slid off the end of the frame members, or the clamps are disengaged from the connection member. Likewise, if the at least two clamps are engaged with opposite flanges of an I-beam or of two I-beams extending laterally of the connection member the clamping mechanism will resist disengagement from the I-beam(s). The elongate connection member may also be clamped lengthwise to a single frame member having an L-shaped section as aforementioned. Rotation of the clamps to possibly disengage the clamping means is not prevented by the last-mentioned arrangement, but may be resisted by the substantially rigid connection of the stanchion assembly with a second stanchion assembly, such as by means of a horizontal rail associated with a safety barrier, or by bracing at least one of the clamps against rotation by means of a bracing member which extends from said clamp to a further clamp engaged with a second laterally spaced frame member. Nevertheless, it is preferred that the jaws of each clamp include releasable locking means adapted to secure the clamp on the frame member and this may be by means of one or more screw threaded locking bolts arranged, for example, to engage the frame member in or adjacent the mouth of the jaws.

Advantageously, the jaws of each clamp are elongate whereby they are adapted to act on a longitudinally extensive section of the frame member and conveniently they are formed from sheet material to define a substantially tubular throat with an elongate slot in the tube wall forming the mouth.

In the preferred embodiment, the aforementioned sleeve is provided to accommodate the elongate connection member with its axis perpendicular to the longitudinal extent of the frame member(s). Alternatively, the aforementioned bracing member may be secured in such sleeve.

An open ended throat of the jaws may be shaped to receive the elongate connection member as well as the frame member section if the connection member is to extend parallel to the frame member in adjustable manner. Alternatively, or in addition, the or a second sleeve may be arranged to adjustably receive the connection member generally parallel to the frame member.

Various embodiments of a stanchion assembly in accordance with the present invention will now be described by way of example only with reference to the accompanying drawings in which.

The various embodiments of stanchion assembly described hereinafter are closely similar in many respects and, for convenience only, where the same or similar parts are referred to, the same reference numerals will be used.

Figure 1:
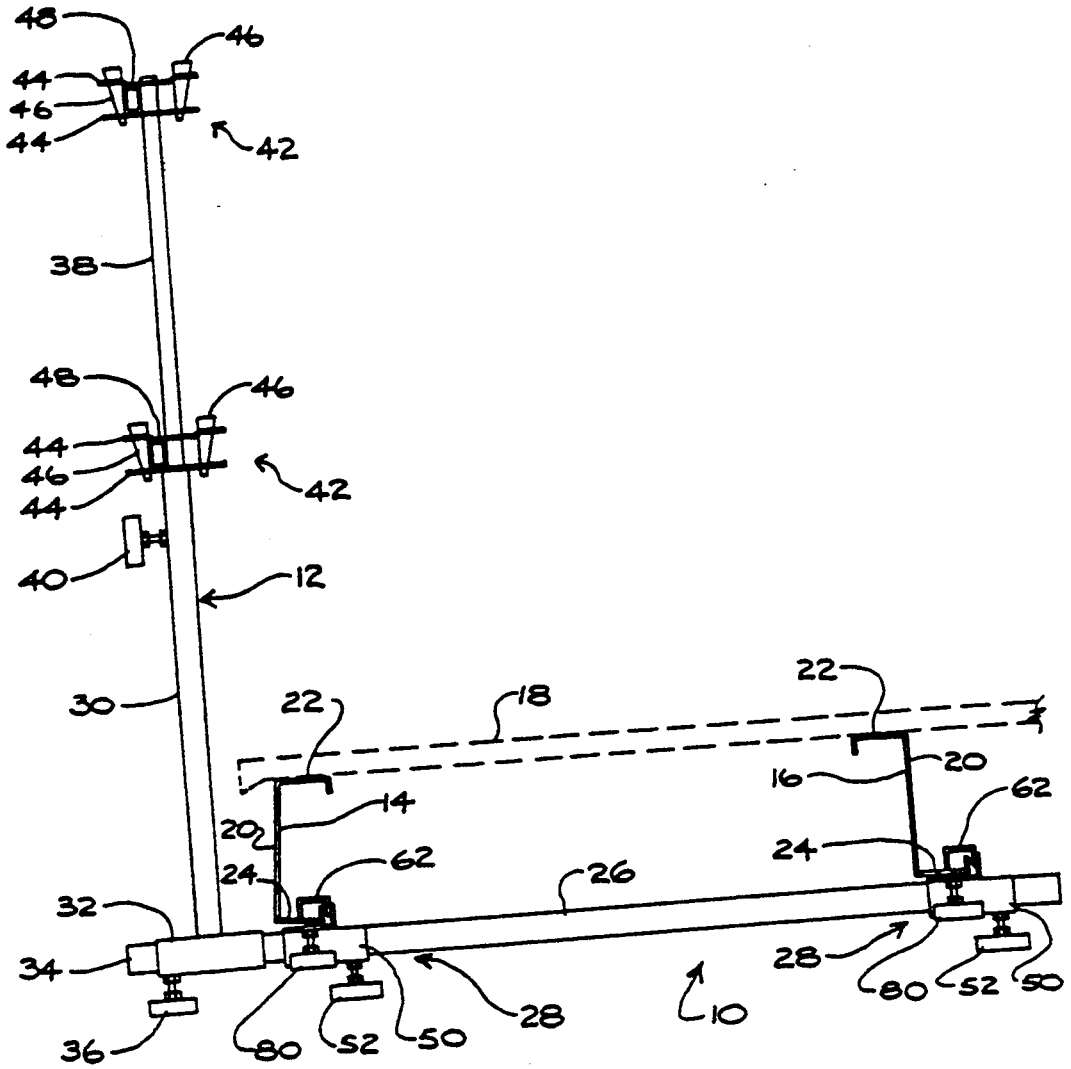
FIG. 1 is a side view of a first embodiment of the stanchion assembly engaged with roof supporting purlins of a building.

Referring firstly to FIG. 1, an adjustable stanchion assembly 10, including an upright stanchion 12, is shown secured to two parallel metal purlins 14 and 16 which are intended to support a roof 18 (shown in dashed lines) that is yet to be secured to the purlins.

Purlins 14 and 16 are respectively shown as "C"-shaped and "Z"-shaped but for the purposes of the invention purlin 14 could be Z-shaped and purlin 16 C-shaped, they could both be C-shaped or could both be Z-shaped. Other shapes are also possible. Both purlins include a central web 20, an upper flange 22 on which the roof 18 is to be supported and a bottom flange 24 which is L-shaped in cross-section having a leg **24*a* connected to the web 20 and a lip 24*b* projecting from the leg 24*a* (shown most clearly in FIG. 2). As shown in FIGS. I and 2 the flanges 24 both extend to the right hand side of the web 20** but one or both may be reversed so that it extends to the left hand side of the web.

Roof 18 is shown inclined slightly so as to allow run-off of water and purlin 16 is inclined slightly also, to accommodate this. However, the web 20 of purlin 14 is used to secure a fascia (not shown) of the building and is therefore vertical. Upper flange 22 of the purlin 14 is inclined from normal to the web to accommodate the inclination of the roof.

The stanchion assembly 10 includes a clamping mechanism which comprises a connecting rod 26 which bridges the purlins 14 and 16 beneath the bottom flanges 24. The connecting rod is of square tubular cross-section and is supported on the bottom flanges 24 of purlins 14 and 16 by respective clamps 28 to be described in detail hereinafter. The stanchion 12 of the assembly 10 comprises a lower support post 30 which is tubular and has welded at its lower end a sleeve 32 of square cross-section whose axis extends perpendicularly to that of the lower support post 30. The sleeve 32 is closely received in sliding manner on a projecting end portion 34 of the connecting rod 26 and is lockable in the desired location by means of a screw threaded locking bolt 36 which threadedly engages the sleeve and projects through the sleeve wall to abut the end portion 34 of the connecting rod. The lower support post 30 may thus be readily spaced sufficiently from the end of roof 18 and from the web 20 of purlin 14 for a gutter to be secure without dismantling the stanchion assembly.

The lower support post 30 telescopically receives an upper support post 38 which can be locked at the desired height by means of a locking bolt 40 of similar construction to the locking bolt 36. The upper support post 38 carries a pair of barrier mounts 42 each of which has a pair of spaced plates 44 welded to the upper support post 38 and having aligned apertures therethrough to receive wedge shaped pegs 46. Each of the barrier mounts 42 is shown with a barrier rail 48 locked in place between the respective spaced plates 44 by means of the peg 46 forcing the barrier rail into abutment with the upper support post 38. Each barrier mount 42 is preferably capable of receiving at least one barrier rail 48 both transversely to the plane of FIG. 1 as shown and parallel to the plane of the Figure. As shown in FIG. 1 each barrier mount 28 has two pegs 46 for receiving a barrier rail 48 on either or both sides of the upper support post 38.

The other end of the barrier rails 48 are supported on a second stanchion assembly 10 (not shown) clamped to the purlins 14 and 16. In an embodiment, or in addition to the barrier mounts 28, the stanchion 12 may carry hooks or other devices to support netting or webbing between the stanchions 12 of the two spaced assemblies 10. Alternatively again, the stanchion 12 may comprise means for carrying, for example, a display sign.

Figure 2:
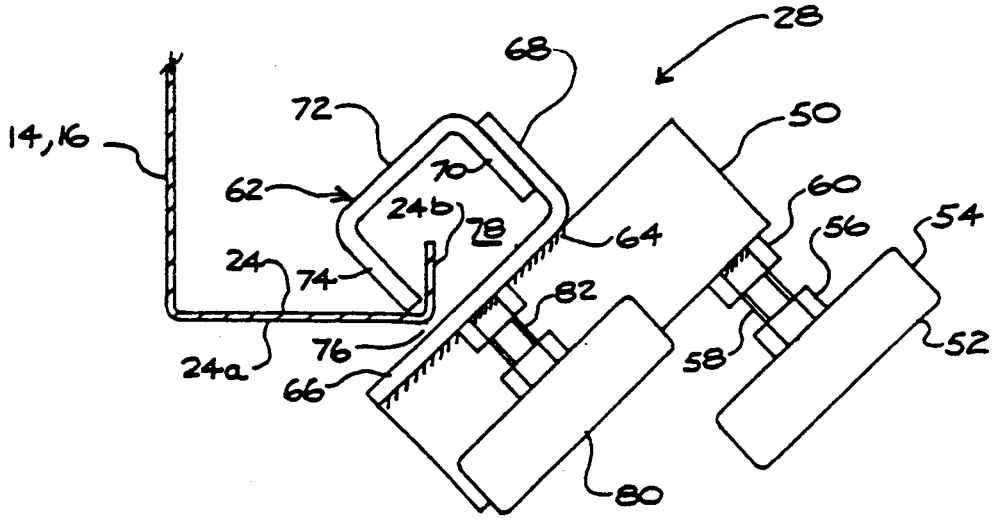
FIG. 2 is an enlarged view of part of FIG. 1 showing a lamp being rotated onto a bottom flange of the purlin.

The clamps 28 shown in FIG. 1 are identical but this is not essential. Referring now to FIG. 2 in which one of the clamps 28 is shown in greater detail, the clamp comprises a sleeve 50 of square cross-section to closely receive the connecting rod 26 in sliding manner. The sleeve 50 has a locking bolt 52, which is of similar construction to the locking bolt 36, to secure the connecting rod 26 in the sleeve. The locking bolt 52 comprises a wing 54 welded to a threaded nut 56 from which a screw threaded stud 58 fixedly projects. The stud 58 screw threadedly engages a threaded nut 60 welded to the wall of the sleeve 50 and the nut 60 overlies an aperture (not shown) in the wall of the sleeve so that the stud 58 can project therethrough to engage the connecting rod 26.

The sleeve 50 of the clamp 28 is welded to a generally sleeve like clamping means 62 whose axis extends transversely of the sleeve 50 to engage the bottom flange 24 of the respective purlin. The clamping means 62 comprises an elongate L-shaped steel section 64 whose longer leg 66 is welded to the sleeve 50 and whose upstanding leg 68 is welded to one leg 70 of an inverted U-shaped steel section 72. The opposite leg 74 of the U-shaped section 72 is spaced slightly from the opposing leg 66 of the L-shaped section 64 to define an endless narrow mouth 76 through which the lip **24*b* of the flange 24 of the purlin can be received. The sections 64 and 72 of the clamping means 62 together define an enlarged throat 78 inwardly of the mouth 76 whose height is greater than the height of the lip 24*b*. The lip 24*b* has a greater height than the spacing between the leg 74 of section 72 and leg 66 of section 64. Thus, flange 24 can only be received in the throat 78 by inserting the lip 24*b* through the mouth 76 and rotating the clamp 28 around the junction between the leg 24*a* and lip 24*b* of the flange. Likewise, the clamp 28 can only be removed from the flange 24 by rotating the clamp over the lip 24*b***.

Figure 4:
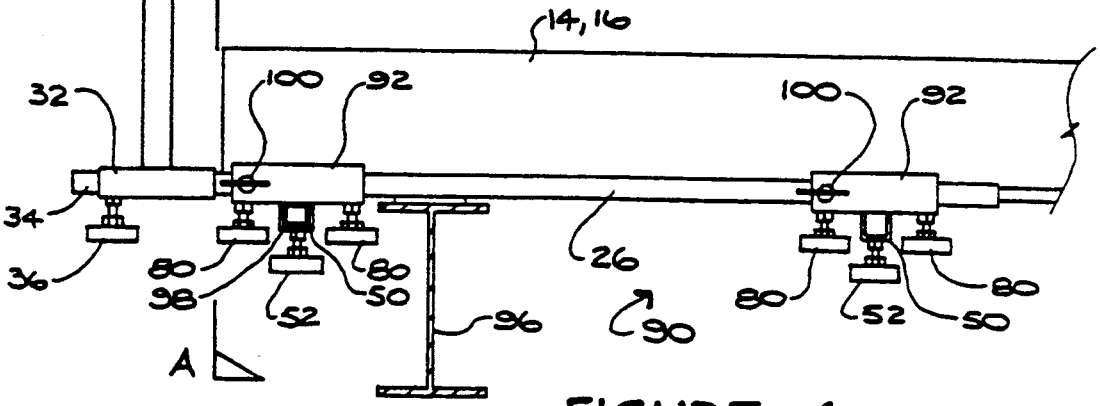
FIG. 4 is a side view of a second embodiment of the stanchion assembly.

It will be appreciated that once the connecting rod 26 extends through the sleeves 50 of both clamps 28 with the clamps mounted on the respective purlins as described, the clamps 28 cannot then be rotated relative to the purlins and are therefore securely held on the purlins. However, it is preferred to lock the clamps 28 onto the purlins and for this purpose a locking bolt 80 is provided which is identical to the locking bolt 52 and whose stud 82 projects through the leg 66 of section 64 to engage the flange 24 in the throat adjacent the mouth 76 and thereby urge the leg **24*a* into abutment with the end portion of the leg 74 of the section 72. Preferably, two locking bolts 80 are provided, one located on each side of the sleeve 50, generally as shown in FIG. 4**.

The clamping means 62 may be formed in one piece so that the leg 68 of section 64 is continuous with leg 70 of section 72, provided there is sufficient strength in the clamping means to resist bending in use.

Figure 6:
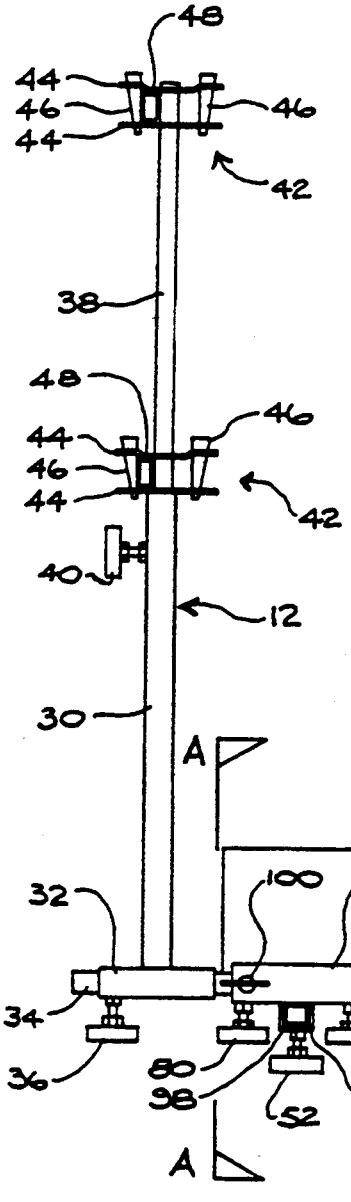
FIG. 6 is a view similar to FIG. 5 illustrating how the first embodiment of stanchion assembly can be arranged to perform the function of the second embodiment.
Figure 6:
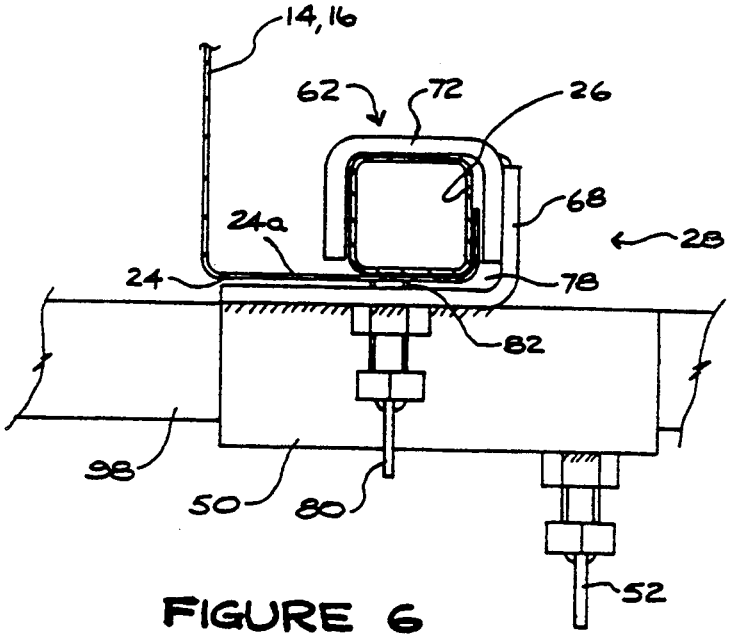

Preferably the throat 78 of the clamping means 72 is sized to receive the or a second connecting rod as shown in FIG. 6, to be described hereinafter.

Figure 3:
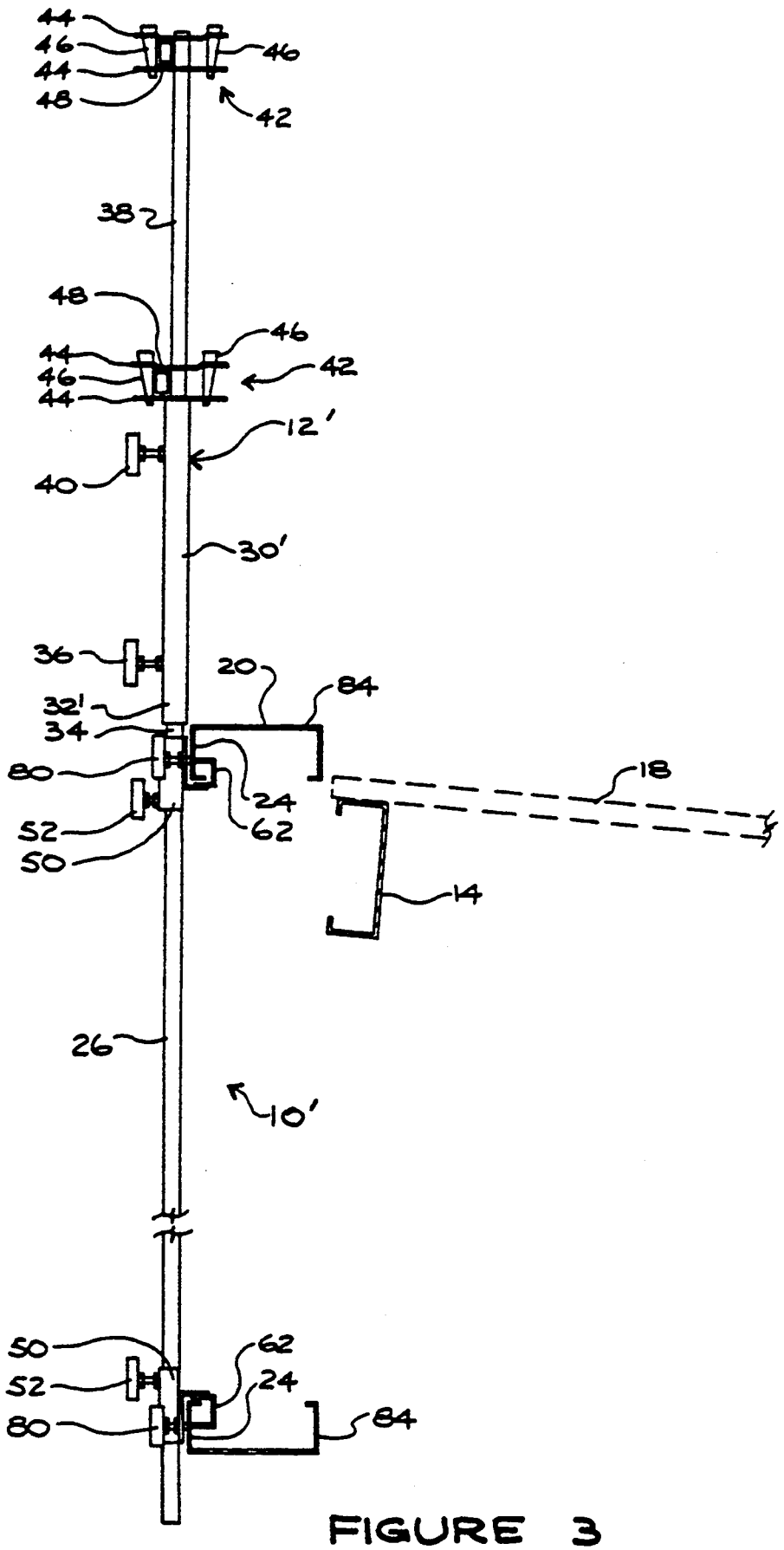
FIG. 3 is a side view of the first embodiment of FIG. 1 modified for use with the wall supporting girts of a building.

Turning now to FIG. 3, a slightly modified stanchion assembly 10' is shown secured to C-shaped girts 84 of the frame building (purlin 14 and roof 18 are also shown) which may support the wall or fascia cladding of the building. The girts 84 are identical to the C-shaped purlin 14 except that they are shown with the web 20 extending, horizontally. The sole modification in the stanchion assembly 10' compared to the stanchion assembly 10 is that the sleeve 32' is continuous and integral with the lower support post 30 of stanchion 12' so that the connecting rod 26 clamped to the vertically spaced girts 84 extends in an upright manner.

In practice, the clamps 28 in FIG. 3 are rotated onto the flange 24 of the girts 84 as described with reference to FIG. 2. The connecting rod 26 is then inserted through the aligned sleeves 50 of the clamps 28 and the locking bolts 80 of the clamping means 62 are then engaged to lock the clamps firmly onto the respective girts. Locking bolts 52 are then engaged to lock the connecting rod to the desired height in the sleeves 50. The connecting sleeve 32' of the stanchion 12' is then telescopically received over the end portion 34 of the connecting rod 26 to support the lower support post 30' and the upper support post 38 is then engaged with the lower support post 30' as described with reference to FIG. 1.

Referring now to FIG. 4, a slightly modified stanchion assembly 90 is shown in which the sole difference compared to the stanchion assembly 10 resides in the provision of an additional sleeve 92 in the each of the two clamps 94 (one is more clearly shown in FIG. 5) to accommodate the connecting rod 26 which extends parallel to the purlin 14 or 16 to which the clamps 94 are secured. In all other respects the clamps 94 are identical to the clamps 28 in FIGS. I and 2, and since the remainder of the stanchion assembly 90 is identical to the stanchion 10 it will not be further described.

Figure 5:
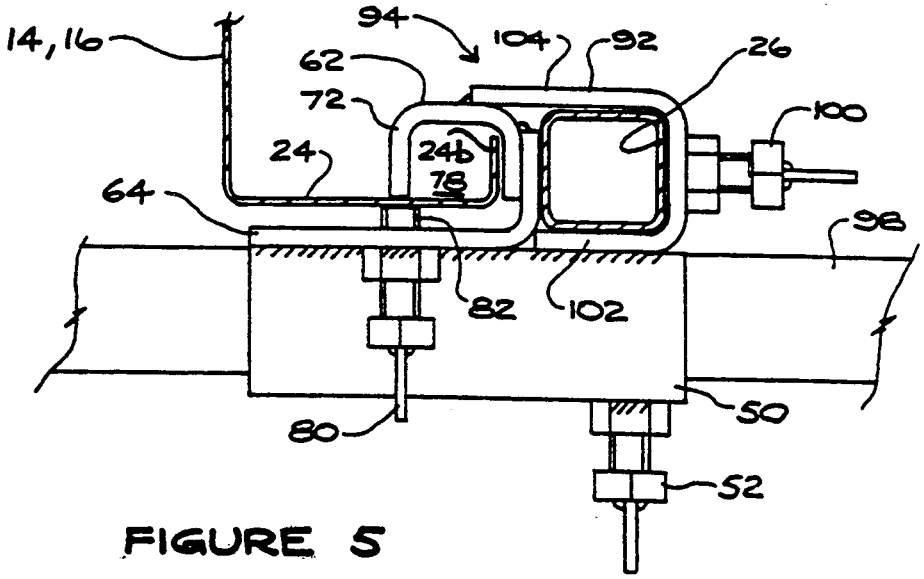
FIG. 5 is an enlarged detail taken along the line A—A in FIG. 4.

In FIGS. 4 and 5 the purlin 14 or 16 is supported on an I-beam rafter 96 extending transversely of the purlin and the clamps 94 are secured to the purlin by rotating the clamping means 62 over the flange 24 as described with reference to FIG. 2 and tightening the locking bolts 80. Since the connecting rod 26 is to extend parallel to the purlin it will not itself resist rotation of the clamps 94 on the flange 24 although the barrier members 48, which extend between the stanchion 12 in FIG. 4 and a second identical stanchion assembly 90 and which are locked in place by the pegs 46, will tend to resist such rotation. However, it is preferred to provide some bracing against such rotation without relying on the barrier members 48, and for this purpose a bracing rod 98 is locked into the sleeve 50 of at least one of the clamps 94 by means of the locking bolt 52 and in the sleeve 50 of a clamp 28 or 94 aligned with the sleeve 50 of the one clamp 94. Thus, rotation of at least the one clamp 94 is prevented in the manner described with reference to FIGS. 1 and 2. The connecting rod 26 may then be slid through the aligned sleeves 92 of the clamps 94 and be locked at the desired length by locking bolts 100 which are identical to the locking bolt 52.

The sleeve 92 on each clamp 94 is formed by an elongate J-shaped metal section of which the shorter leg 102 is welded to the sleeve 50 and the longer leg 104 overlies and is welded to the base of the U-shaped section 72 of the clamping means 62. The sleeve 92 is shaped to closely receive the connecting rod 26 in sliding manner with such sliding being prevented by the locking bolt 100.

Once the connecting rod 26 is secured, the stanchion 12 may be mounted on it in the manner described with reference to FIG. 1.

Referring now to FIG. 6, as briefly described already the arrangement described with reference to FIGS. 4 and 5 in which the connecting rod extends parallel to the purlin 14 or 16 is modified for use with one of the clamps 28 described with reference to FIGS. 1 and 2. Thus, in FIG. 6 rather than providing a second sleeve 92 for the connecting rod 26 and extending transversely to the sleeve 50, the connecting rod 26 is accommodated in the throat 78 of the clamping means 62 of clamp 28.

In the arrangement of FIG. 6, the flange 24 is introduced into the throat 78 in the manner described with reference to FIG. 2, the bracing rod 98 is introduced into the sleeve 50 and locked in place by the locking bolt 52, the connecting rod 26 is slid through the sleeve-like throat 78 to overlie the flange 24, and with the connecting rod 26 in the correct location the locking bolts 80 are tightened so that the screw threaded stud 82 engages the leg 24*a* of the flange 24 which abuts the connecting rod 26 and urges it into engagement with the base of the U-shaped section 72.

In FIGS. 2 and 6 the locking bolts 80 are shown engaging the leg 24*a* within the throat 78 of the clamping means 62, whereas in FIG. 5 the locking bolts 80 are displaced slightly to engage the leg 24*a* in the mouth 76. The reason for this variation is that in FIGS. 2 and 6 the leg 24*a* of flange 24 may be braced against the connecting rod 26, or a second connecting rod extending through the sleeve like throat, whereas in FIG. 5 the connecting rod 26 extends through a separate sleeve 92 and the leg 24*a* of flange 24 is braced directly against the end portion of leg 74 of the U-shaped section 72.

Figure 7:
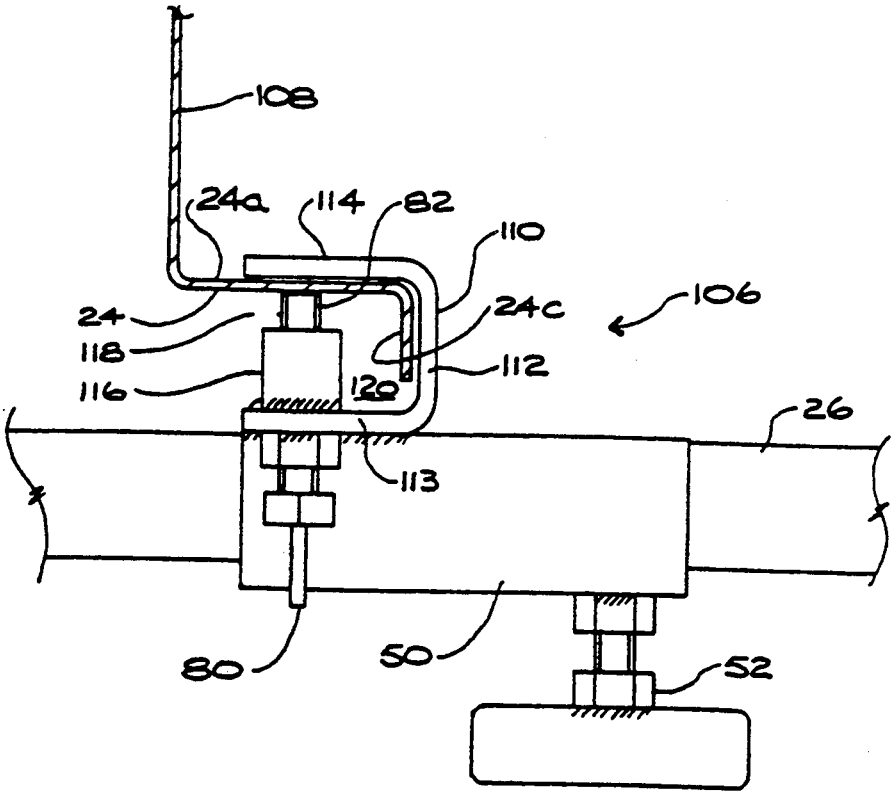
FIG. 7 is a view similar to FIG. 6 but showing a further modification.

Referring now to FIG. 7, a view similar to FIG. 2 is shown except that the clamp 106 is modified to accommodate a purlin 108 with a bottom flange 24 having a downwardly turned lip 24*c*. In clamp 106, a clamping means 110 comprises a U-shaped metal section 112 of which one leg 113 is welded to the sleeve 50 in which the connecting rod 26 is received and locked in place by the locking bolt 52. The opposite leg 114 extends parallel to the leg 113 and an element 116 is welded to the interior surface of the leg 113 to define with the leg 114 a mouth 118 of restricted width. Although only one element 116 is shown, it would be usual to have two such spaced elements or one elongate element 116. An enlarged throat 120 is defined inwardly of the element(s) 116.

In use, the clamp 106 is rotated onto the flange 24 so that the lip 24*c* passes through the mouth 118 and is received in the throat 120. The connecting rod 26 is then locked into the sleeve 50 and a pair of spaced locking bolts 80 (only one shown) is tightened to engage the locking studs 82 with the leg 24*a* of the flange 24 and force it into abutment with the leg 114 of U-shaped section 112. Compared to the clamp 28, the locking studs 82 are somewhat longer and it will be appreciated that each of the locking studs may pass through the or a respective element 116.

Figure 8:
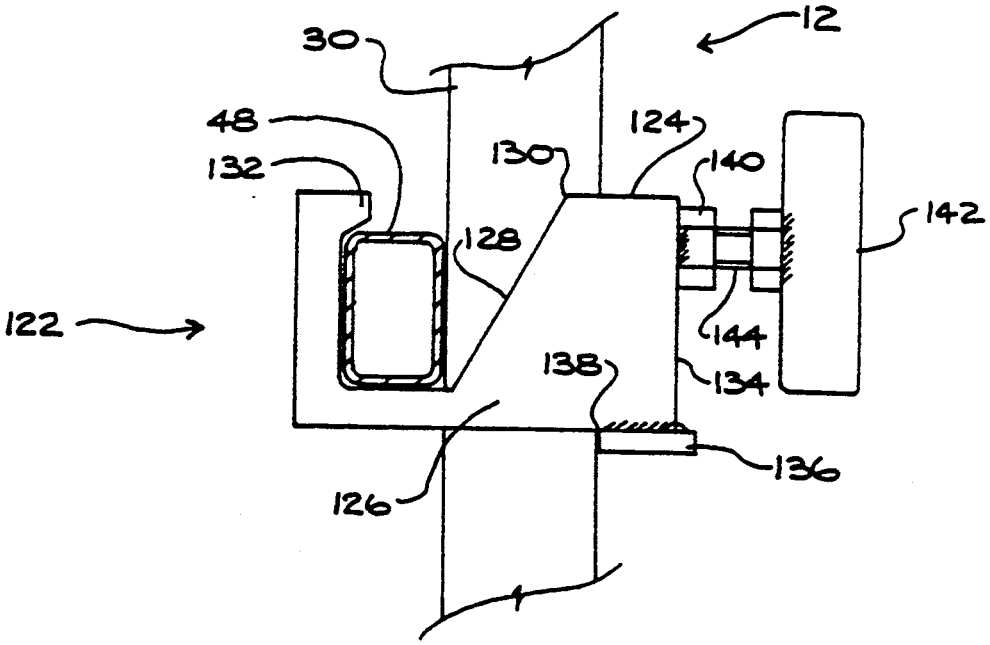
FIG. 8 is a detail of a bracket for supporting a rail on the stanchion assembly.

FIG. 8 illustrates an additional bracket 122 which may be clamped to, for example, the lower support post 30 of the stanchion 12 to support a further barrier rail 48 adjacent the level of the purlins or upper girt to which the stanchion 12 is secured.

The bracket 122 comprises a U-shaped fitting 124 which extends with respective legs 126 (one only shown) on opposite sides of the lower support post 30. The legs 126 of the fitting 124 have aligned cut-outs 128 therein which are open at an upper edge 130 of the legs. Each leg 126 defines a lip 132 at its remote end which projects into the cutout 128 to prevent upwards withdrawal of the barrier rail 48 when the barrier rail is secured.

On its base 134 the fitting 124 has a plate 136 welded to the bottom edge to define a fulcrum point 138 about which the bracket pivots as the fitting 124 is adjusted to lock the barrier rail in place. In order to enable this adjustment to be effected, the base 134 has a screw threaded nut 140 welded thereto in alignment with an aperture (not shown) through an upper portion of the base. A locking bolt 142 having a threaded stud 144 co-operating with the nut 140 is rotatable to engage the upper support post 30 and cause the pivoting about the fulcrum point 138.

Figure 9:
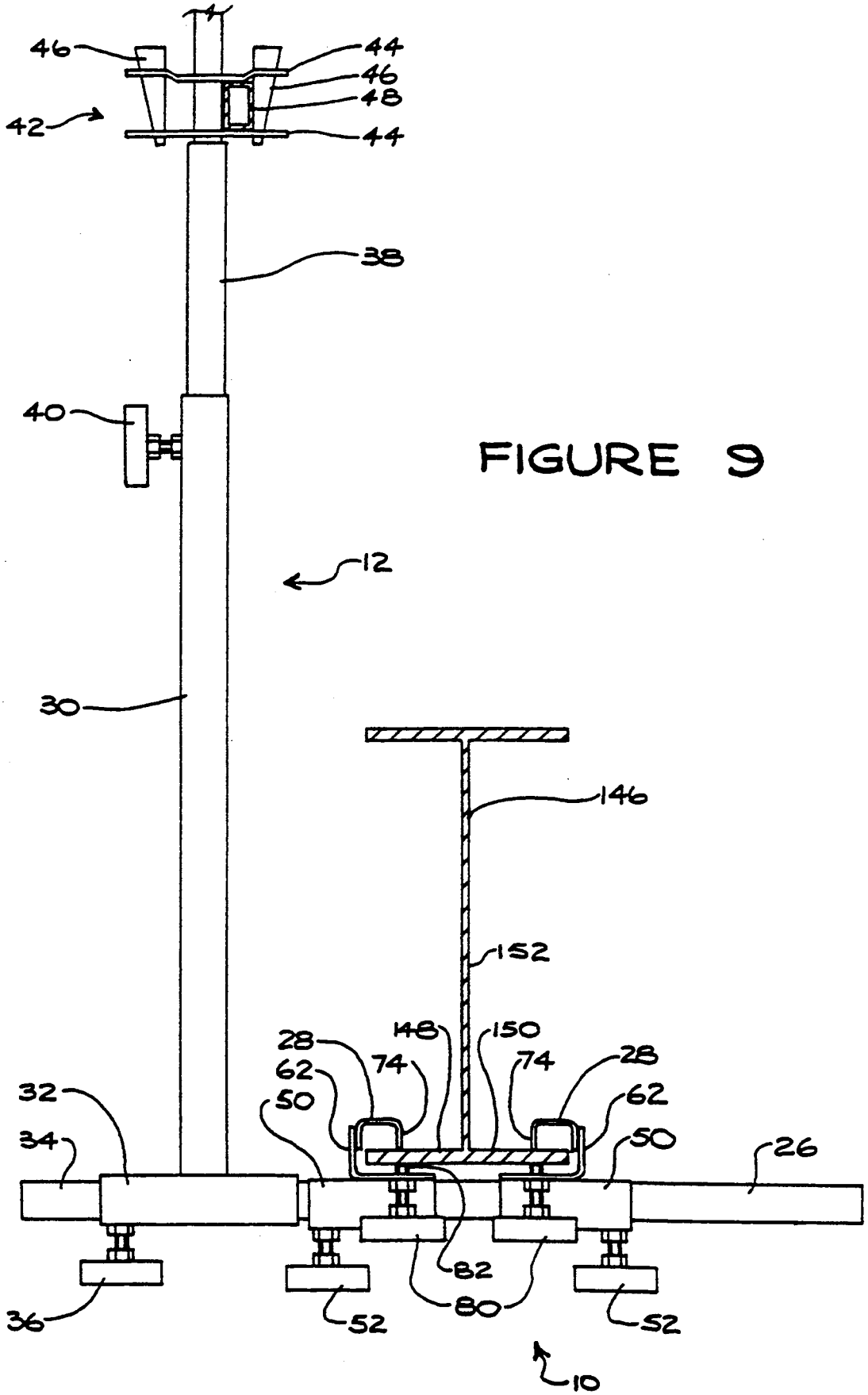
FIG. 9 illustrates the use of the first embodiment of stanchion assembly with an I-beam.

Referring now to FIG. 9, the stanchion assembly 10 is adjusted compared to FIG. 1 to make it suitable to be clamped to an I-beam 146 transversely to the length of the beam. The I-beam 146 has opposed bottom linear flanges 148 and 150 projecting to respective sides of a vertical web 152. In this arrangement, each of the clamps 28 is clamped to a respective one of the flanges 148 and 150, and for this purpose the left hand clamp 28 in FIG. 1 must be reversed for engagement with the flange 148. It will be appreciated that the flanges 148 and 150 are not of L-shaped section but in use the clamping means 62 of each of the clamps is disposed onto the respective flange and the connecting rod 26 is slid through the sleeves 50 and locked in the sleeves at the desired location by means of the locking bolts 52. The locking bolts 80 of the two clamping means 62 are then tightened so as to force the leg 74 of the clamping means into frictional engagement with the respective flange.

For additional security, if the connecting rod 26 is sufficiently long to bridge two I-beams 152, it may also be clamped to the second I-beam in a similar manner. Alternatively, only one clamp 28 may be applied to each of the X-beams, preferably with the clamps being secured to opposite ones of the flanges 148 and 150 on the I-beams.

The construction, arrangement and operation of the stanchion assembly and components thereof illustrated in the drawings can be readily understood by reference to the preceding description. It will be seen that the described stanchion assemblies can enable a stanchion to be readily supported from purlins, beams and/or girts of a frame building and the stanchion can then be used to mount barriers, horizontal rails, barrier netting, display signs and the like. The stanchion assembly can be readily dismantled from the building for reuse at another location. Those skilled in the art will readily appreciate that many modifications and variations may be made to the stanchion assemblies described herein, and all such modifications and variations should be considered as falling within the scope of the present invention. In particular, it will be appreciated that the restricted mouth of the clamps may be defined by pegs or other projections which extend from one or both sides into an open side of the enlarged throat.

We claim:

1. An adjustable stanchion assembly for use with a frame building which has an elongate frame member, said elongate frame member having an elongate flange and a distal lip extending along said flange, said stanchion assembly comprising:

(A) a support post for a safety barrier or the like;

(B) a clamping mechanism for clamping the support post to a frame building, the clamping mechanism comprising:

(B1) an elongate connection member of non-circular cross-sectional shape; and (B2) at least two clamps which are adapted to be clamped to said frame member of said frame building, each of said clamp comprising;

(B2a) a sleeve, (B2ai) said connection member extending through said sleeve thereby making said clamp slidably mounted on said connection member and selectively relatively adjustable along said connection member, and (B2aii) said sleeve having an internal configuration of a non-circular cross-sectional shape that, in combination with the non-circular cross-sectional shape of said connection member, makes said clamp non-rotatable with respect to said connection member; and (B2b) a pair of opposed jaws which are affixed to said sleeve, said jaws defining:

(B2bi) a mouth of restricted width, said distal lip having a greater height than the restricted width of said mouth; and (B2bii) a throat portion behind the mouth having a height and a width substantially parallel to the width of the mouth and which is greater than said restricted width of said mouth and at least as high as said distal lip, (B2biii) whereby the frame member can only be received in and removed from the jaws by relative rotation of the clamp around said flange with a distal lip;

(B2biv) the axis of said pair of jaws being substantially parallel to the axis of said sleeve; and (C) means for securing said support post to the connection member such that said support post is supported in cantilevered manner from the frame member by the clamping mechanism.

2. An adjustable stanchion assembly according to claim 1 wherein the support post is adjustably secured to the clamping mechanism.

3. An adjustable stanchion assembly according to claim 1 wherein the elongate connection member comprises a rod of square cross-section.

4. An adjustable stanchion assembly according to claim 1 wherein the elongate connection member comprises a rod which is hollow.

5. An adjustable stanchion assembly according to claim 1 wherein the sleeve of at least one of said clamps further comprises releasable locking means to prevent sliding of said connection member.

6. An adjustable stanchion assembly according to claim 1 wherein at least one of the clamps includes a second sleeve for slidingly receiving a further elongate connection member therein, said second sleeve substantially normal to the first-mentioned sleeve, and releasable locking means to resist sliding of said further connection member.

7. An adjustable stanchion assembly according to claim 1 wherein the jaws of each clamp include releasable locking means adapted to secure the clamp on the frame member.

8. An adjustable stanchion assembly according to claim 7 wherein the releasable locking means of the jaws is arranged to engage the frame member in the mouth of the jaws.

9. An adjustable stanchion assembly according to claim 1 wherein the jaws are elongate whereby said jaws are adapted to act on a longitudinally extensive section of the frame member.

10. An adjustable stanchion assembly according to claim 9 wherein the jaws are formed from sheet material to define a substantially tubular throat with an elongate slot in said tube forming the mouth.

11. An adjustable stanchion assembly for use with a frame building which has at least two elongate frame members, each of said elongate frame members having an elongate flange and a distal lip extending along said flange, said stanchion assembly comprising:

(A) a support post for a safety barrier or the like;

(B) a clamping mechanism for clamping the support post to a frame building, the clamping mechanism comprising:

(B1) an elongate connection member of non-circular cross-sectional shape; and (B2) at least two clamps which are adapted to be clamped to respective frame members of said frame building, each of said clamp comprising:

(B2a) a sleeve, (B2ai) said connection member extending through said sleeve, thereby making said clamp slidably mounted on said connection member and selectively relatively adjustable along said connection member, and (B2ii) said sleeve having an internal configuration of a non-circular cross-sectional shape that, in combination with the non-circular cross-sectional shape of said connection member, makes said clamp non-rotatable with respect to said connection member; and (B2b) a pair of opposed jaws which are affixed to said sleeve, said jaws defining:

(B2bi) a mouth of restricted width, said distal lip having a greater height than the restricted width of said mouth; and (B2bii) a throat portion behind the mouth having a height and a width substantially parallel to the width of the mouth and which is greater than said restricted width of said mouth and at least as high as said distal lip, (B2biii) whereby the frame member can only be received in and removed from the jaws by relative rotation of the respective clamp around said flange with a distal lip, and (B2iv) the axis of said pair of jaws being substantially normal to the axis of said sleeve; and (C) means for securing said support post to the connection member such that said support post is supported in cantilevered manner from the frame building by the clamping mechanism.

12. An adjustable stanchion assembly according to claim 11 wherein the support post is adjustable secured to the clamping mechanism.

13. An adjustable stanchion assembly according to claim 11 wherein the elongate connection member comprises a rod of square cross-section.

14. An adjustable stanchion assembly according to claim 11 wherein the elongate connection member comprises a rod which is hollow.

15. An adjustable stanchion assembly according to claim 11 wherein the sleeve of at least one of said clamps comprises releasable locking means to prevent sliding of said connection member.

16. An adjustable stanchion assembly according to claim 15 wherein at least one of the clamps includes a second sleeve for slidingly receiving a further elongate connection member therein, said second sleeve being substantially normal to the first-mentioned sleeve, and releasable locking means to resist sliding of said further connection member.

17. An adjustable stanchion assembly according to claim 11 wherein the jaws of each clamp include releasable locking means adapted to secure the clamp on the frame member.

18. An adjustable stanchion assembly according to claim 17 wherein the releasable locking means of the jaws is arranged to engage the frame member in the mouth of the jaws.

19. An adjustable stanchion assembly according to claim 11 wherein the jaws are elongate whereby said jaws are adapted to act on a longitudinally extensive section of the frame member.

20. An adjustable stanchion assembly according to claim 19, wherein the jaws are formed from sheet material to define a substantially tubular throat with an elongate slot in said tube forming the mouth.

21. An adjustable stanchion assembly for use with a frame building which has an elongate frame member, said elongate frame member having an elongate flange and a distal lip extending along said flange, said stanchion assembly comprising:

(A) a support post for a safety barrier or the like;

(B) a clamping mechanism for clamping to said frame building, said clamping mechanism comprising:

(B1) an elongate connection member of non-circular cross-sectional shape; and (B2) at least two clamps adapted to be clamped to said elongate frame member of said frame building, each of said clamps comprising:

(B2a) a pair of opposed jaws, said jaws defining:

(B2ai) a mouth of restricted width, said distal lip having a greater height than the restricted width of said mouth;

(B2aii) a throat portion behind said mouth having a height and width substantially parallel to the width of the mouth and which is greater than the restricted width of said mouth and at least as high as said distal lip, (B2aiii) whereby the frame member can only be received in and removed from the jaws by relative rotation of the respective clamp around said flange with said distal lip, (B2aiv) said height and width of said throat being such that when said clamp is rotated onto said flange and said distal lip and a portion of said flange are in said throat, said connection member can also extend through said throat thereby making said clamp slidably mounted on said connection member and selectively relatively adjustable along said connection member, and (B2av) said throat having an internal configuration of non-circular cross-sectional shape, which in combination with the non-circular cross-sectional shape of said connection member makes said clamp non-rotatable with respect to said connection member; and (C) means for securing said support post to said connection member of said clamping mechanism such that said support post is supported in a cantilevered manner from the frame building by the clamping mechanism.

22. An adjustable stanchion assembly according to claim 21 wherein the support post is adjustable secured to the clamping mechanism.

23. An adjustable stanchion assembly according to claim 21 wherein the elongate connection member comprises a rod of square cross-section.

24. An adjustable stanchion assembly according to claim 21 wherein the elongate connection member comprises a rod which is hollow.

25. An adjustable stanchion assembly according to claim 24 wherein the threat of at least one of said clamps further comprises releasable locking means to prevent sliding of said connection member.

26. An adjustable stanchion assembly according to claim 21 wherein at least one of the clamps further comprises a sleeve for slidingly receiving a further elongate connection member therein, said sleeve being substantially normal to said throat, and releasable locking means to resist sliding of said further connection member.

27. An adjustable stanchion assembly according to claim 21 wherein the jaws of each clamp include releasable locking means adapted to secure the clamp on the frame member.

28. An adjustable stanchion assembly according to claim 21 wherein the jaws are formed from sheet material to define a substantially tubular throat with an elongate slot in said tube forming the mouth.

* * * * *

UNITED STATES PATENT AND TRADEMARK OFFICE

CERTIFICATE OF CORRECTION

PATENT NO. : 5,353,891.

DATED : October 11, 1994

INVENTOR(S) : Cornelis Griek et al.

It is certified that error appears in the above-indentified patent and that said Letters Patent is hereby corrected as shown below:

Column 2, line 15, change "Preferably" to --preferably--; line 62, change "the-frame" to --the frame--.

Column 3, line 47, change "lamp" to --clamp--.

Column 4, line 16, change "FIGS. I" to --FIGS. 1--; line 66, after "an" insert --alternative--.

Column 6, line 1, after "extending" delete ","; line 29, change "FIGS. I" to --FIGS. 1--.

Column 8, line 37, change "X-beams" to --I beams--.

Column 9, line 5 (claim 1), change "clamp" to --clamps--; line 55, (claim 6) after "sleeve" insert --being--.

Column 10, line 20 (claim 11), change "clamp" to --clamps--; line 27, (claim 11), change "(B2ii)" to --(B2aii)--; line 54 (claim 12) change "adjustable" to --adjustably--.

UNITED STATES PATENT AND TRADEMARK OFFICE

CERTIFICATE OF CORRECTION

PATENT NO. : 5,353,891

DATED : October 11, 1994

INVENTOR(S) : Cornelis Griek et al.

It is certified that error appears in the above-indentified patent and that said Letters Patent is hereby corrected as shown below:

Column 11, line 19 (claim 20), after "19" delete ",".

Column 12, line 21 (claim 22), change "adjustable" to --adjustably--;
line 30 (claim 25), change "claim 24" to --claim 21-- and change "threat" to --throat--.

Signed and Sealed this

Third Day of January, 1995

Bruce Lehman

*Attest:*

BRUCE LEHMAN

*Attesting Officer*

*Commissioner of Patents and Trademarks*